US005336004A

United States Patent [19]

Harada et al.

[11] Patent Number: 5,336,004

[45] Date of Patent: Aug. 9, 1994

[54] DOT PRINTER

[75] Inventors: Hiroyuki Harada; Akio Tajima; Takashi Kogo; Tadashi Nagakawa; Hajima Oda; Haruo Inoue; Tsuyoshi Hayakawa, all of Tokyo, Japan

[73] Assignee: Seikosha Co., Ltd., Tokyo, Japan

[21] Appl. No.: 137,901

[22] Filed: Oct. 14, 1993

Related U.S. Application Data

[63] Continuation of Ser. No. 747,769, Aug. 20, 1991, abandoned.

[30] Foreign Application Priority Data

Aug. 20, 1990 [JP] Japan ..... 2-218550
Sep. 29, 1990 [JP] Japan ..... 2-103075[U]
Oct. 23, 1990 [JP] Japan ..... 2-284556

[51] Int. Cl.[5] ..... B41J 11/58; B41J 13/10

[52] U.S. Cl. ..... 400/624; 400/23; 400/88; 400/208; 400/595; 400/629; 400/636

[58] Field of Search ..... 400/23, 29, 48, 88, 400/185, 208, 578, 595, 624, 626, 629, 634, 636, 693, 691

[56] References Cited

U.S. PATENT DOCUMENTS

| | | | |
|---|---|---|---|
| 4,053,042 | 10/1977 | Hess | 400/196 |
| 4,279,522 | 7/1981 | Yonkers | 400/196.1 |
| 4,301,957 | 11/1981 | Shore | 226/118 |
| 4,433,925 | 2/1984 | Fujiwara | 400/88 |
| 4,526,486 | 7/1985 | Kikuchi et al. | 400/322 |
| 4,609,295 | 9/1986 | Shimodaira | 400/624 |
| 4,613,245 | 9/1986 | Ikeda et al. | 400/322 |
| 4,646,635 | 3/1987 | Salazar et al. | 400/322 |
| 4,770,555 | 9/1988 | Deschamps et al. | 400/624 |
| 4,828,406 | 5/1989 | Mosciatti et al. | 400/48 |
| 4,904,100 | 2/1990 | Enix | 400/613 |
| 4,958,950 | 9/1990 | Kobayashi et al. | 400/629 |
| 4,988,224 | 1/1991 | Furrow et al. | 400/194 |
| 5,007,750 | 4/1991 | Goubeaux | 400/249 |
| 5,017,033 | 5/1991 | Hermann et al. | 400/691 |
| 5,061,097 | 10/1991 | Piatt | 400/691 |

FOREIGN PATENT DOCUMENTS

| | | | |
|---|---|---|---|
| 0015142 | 9/1980 | European Pat. Off. . | |
| 0219624 | 4/1987 | European Pat. Off. . | |
| 0315487 | 5/1989 | European Pat. Off. . | |
| 3048127 | 9/1981 | Fed. Rep. of Germany . | |
| 3023907 | 3/1982 | Fed. Rep. of Germany . | |
| 3138111 | 4/1983 | Fed. Rep. of Germany . | |
| 4106017 | 5/1991 | Fed. Rep. of Germany . | |
| 0104384 | 6/1985 | Japan | 400/185 |
| 0003975 | 1/1987 | Japan | 400/624 |
| 63-78781 | 4/1988 | Japan . | |
| 0078783 | 4/1988 | Japan | 400/185 |
| 63-149177 | 6/1988 | Japan . | |
| 0224966 | 9/1988 | Japan | 400/120 HE |
| 2046671 | 11/1980 | United Kingdom . | |
| 2212447 | 7/1989 | United Kingdom . | |

OTHER PUBLICATIONS

IBM Tech Disc Bull; vol. 28; No. 4; Sep. 1985; p. 1400.
Patent Abstracts of Japan, vol. 13, No. 200 (P-869) May 12, 1989 & JP-A-1 020 563 (Takefumi) Jan. 24, 1989 *abstract*.

*Primary Examiner*—David A. Wiecking
*Assistant Examiner*—Christopher A. Bennett
*Attorney, Agent, or Firm*—Jordan and Hamburg

[57] ABSTRACT

A dot printer includes: a platen and a printing head encased in a printer case in the vertical direction; a paper housing portion provided laterally of the platen; a feed roller disposed laterally of the printing head for feeding a paper taken out of a paper housing portion to the printing head; and a discharge roller disposed laterally of the printing head for discharging the paper outside of the case. With this construction, the printer can be made thin and can also be miniaturized.

47 Claims, 9 Drawing Sheets

DOT PRINTER

This application is a continuation of application Ser. No. 07/747,769, filed Aug. 20, 1991, now abandoned.

FIELD OF THE INVENTION

This invention relates to a dot printer.

BACKGROUND OF THE INVENTION

In a conventional dot printer, a feed cassette is loaded, and paper is taken out of the feed cassette. Thereafter, the paper is fed out between the platen and the printing head by a feed roller. Printing is then performed by the printing head. After the printing process has been effected, the paper can be discharged by a discharge roller.

This type of dot printer is constructed as follows. The feed cassette is loaded in a position under the printing head, or the printing head is disposed in a horizontal direction to confront the platen. The feed roller and the discharge roller are placed on the upper and lower sides thereof. This construction presents a problem in which the feed cassette, the feed roller and the discharge roller are provided in line in the vertical direction with respect to the printing head, resulting in an increase in total height.

SUMMARY OF THE INVENTION

Accordingly, it is an object of the present invention to provide a thin dot printer.

To accomplish the foregoing object, according to the present invention, there is provided a dot printer comprising: a platen and a printing head so encased in a printer case as to confront each other in the vertical direction; a paper housing portion provided sideways from the upstream side of the platen; a feed roller disposed in line sideways from the upstream side of the printing head for feeding a paper taken out of the paper housing portion towards the printing head; and a discharge roller disposed in line sideways from the downstream side of the printing head for discharging the paper printed by the printing head.

According to the construction described above, the printing head and the platen are disposed opposite to each other in the vertical direction. The paper housing portion, the feed roller and the discharge roller are provided sideways in line. These components are therefore placed compactly in the vertical direction- The printer can thereby be made thin.

The paper housing portion may be a feed cassette loaded into the printer case or encased in the printer case. Especially when the paper housing portion is encased in the printer case, it is unnecessary to provide a holding mechanism for holding the feed cassette. Thus, no extra cost and no extra space are required.

Where the printer case incorporates the paper housing portion, the upstream end of the paper housing portion is opened. A cover capable of opening and closing the opening is provided at this opening. It is thus possible to prevent dust and the like from entering the paper housing portion from the outside of the printer case.

The paper housing portion is so incorporated in the printer case as to be superimposed with the drive control circuit board. It is therefore feasible to attain miniaturization because of the arrangement that the paper housing portion is disposed in a dead space juxtaposed to the circuit board.

The printer case is formed in a plane box-like configuration in which the upper surface thereof is flat such that a personal computer and the like can be placed on the printer case. This is convenient in terms of installation space and operability.

One embodiment of the present invention will hereinafter be described in detail with reference to the accompanying drawings.

DESCRIPTION OF THE PREFERRED EMBODIMENTS

Figure 1:
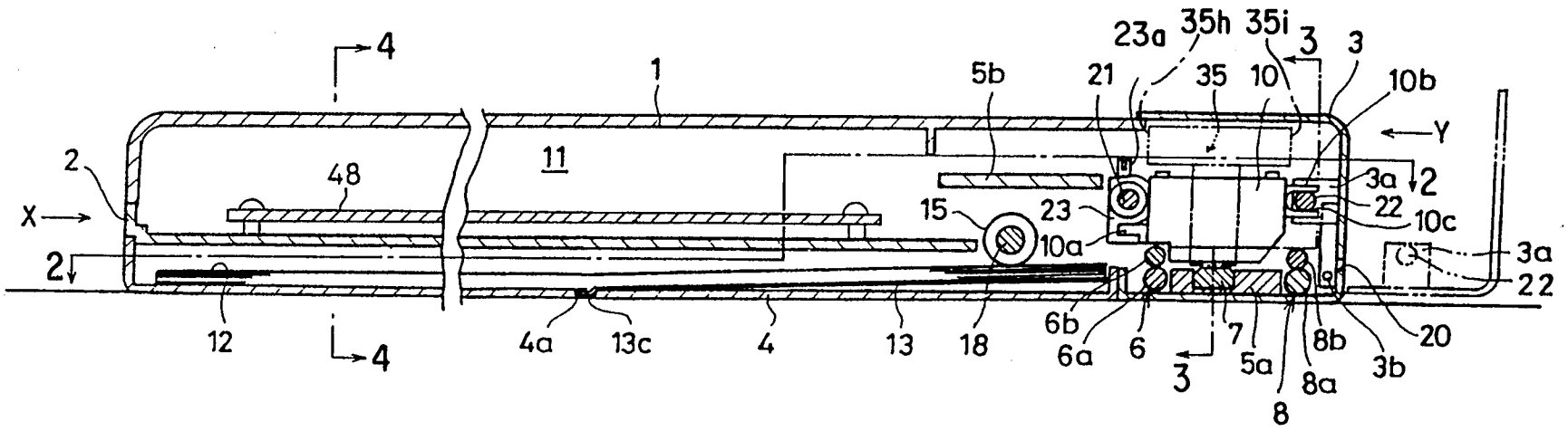
FIG. 1 is a sectional view taken in a paper carrying direction illustrating a dot printer to which the present invention is applied.

Referring to FIG. 1, a printer casing comprises an upper case 1 having a flat upper surface, a lower case 2 and a cover 3 provided at the front thereof. The printer casing has an external appearance in the form of a plane box-like configuration in which the upper surface is flat. Formed at the bottom of the lower case 2 is a loading unit of a feed cassette 4 serving as a paper housing portion. Frames 5*a* and 5*b* are also fixed to the bottom of the lower case 2.

The feed cassette 4 is disposed in the rear of the bottom of the lower case 2. A feed roller means 6, a platen 7 and a discharge roller means 8 are disposed in front of the bottom thereof. A printing head 10 is disposed upwardly of the platen 7 as to face thereto.

Figure 4:
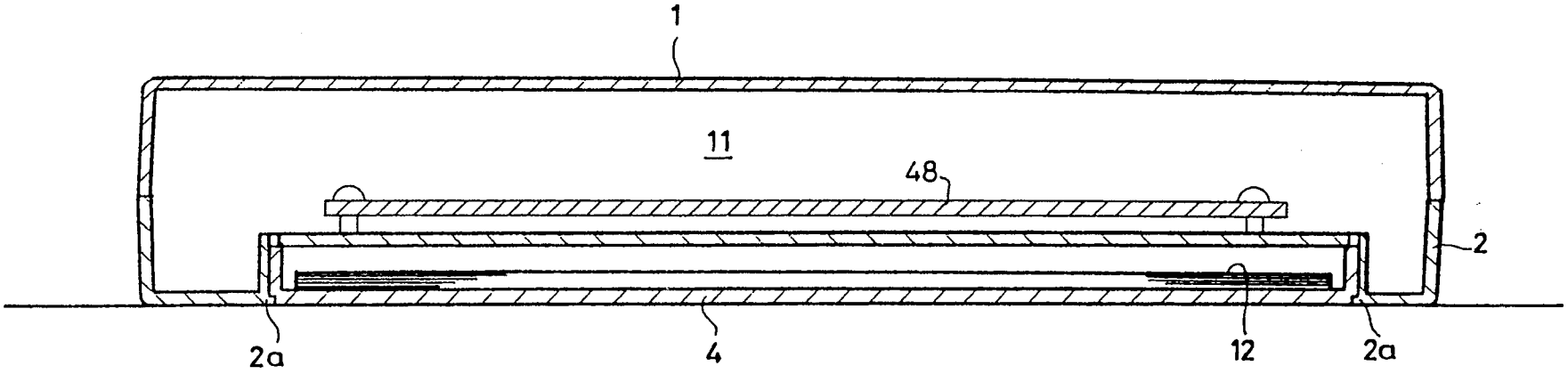
FIG. 4 is a sectional view taken substantially along the line 4—4 of FIG. 1.

The feed cassette 4 is of a box type in which the upper surface is opened. The cassette 4 is loaded from the direction indicated by arrow X. In a loaded state of the feed cassette 4, the lower surface of the lower case 2 is substantially flush with the lower surface of the feed cassette 4. More specifically, as illustrated in FIG. 4, a stepped portion 2*a* is formed in the loading portion of the feed cassette 4. The feed cassette 4 is engaged with this stepped portion, whereby the lower surface thereof is substantially flush with the lower surface of the lower case 2. A drive control circuit board 48 is secured in a space 11 above the loading portion of the feed cassette 4 in such a way that the circuit board overlies the feed cassette 4. Namely, the feed cassette 4 is so loaded into the printer case as to underlie in the circuit board 48. The circuit board 48 incorporates a control circuit. This control circuit controls the operations of a line feed motor 16 and a carriage motor 26 which will be further described hereinafter.

Figure 2:
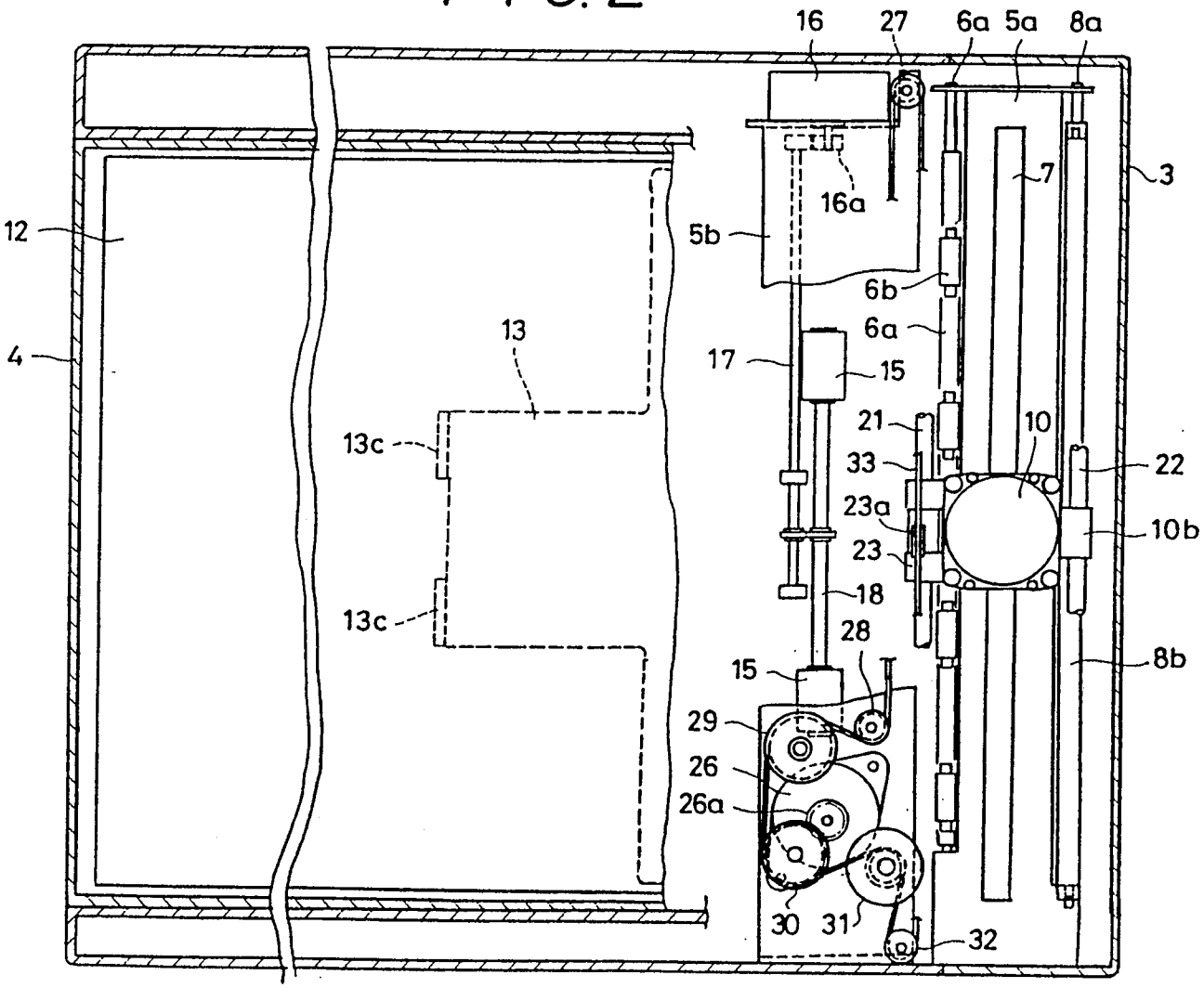
FIG. 2 is a sectional view taken substantially along the line 2—2 of FIG. 1.

A stack of paper 12 is set in the feed cassette 4 via an opening formed in the upper surface thereof. A hopper plate 13 (see FIG. 2) is attached to the bottom of the front part of the feed cassette 4. The hopper plate 13, as illustrated in FIG. 2, has a T-shaped configuration. A root part 13*c* thereof is so axially supported as to fit into a hole 4*a* in the feed cassette 4, whereby the hopper plate is pivotable about this point. Provided downwardly of the hopper plate is a biasing means (not illustrated) for biasing upwards the front part of the hopper plate 13. In the loaded state of the feed cassette 4, the hopper plate 13 is pushed up by this biasing means. The papers 12 are thereby pushed against picking rollers 15. As regards the picking rollers 15, as shown in FIG. 2, a shaft 17 is rotated through a gear train 16*a* by a line feed motor 16 attached to the right end of the frame 5*b*. A rotatable shaft 18 has its right and left ends fitted with the picking rollers 15. The picking rollers 15 have an unillustrated built-in clutch. The paper 12 is taken out by the picking rollers 15 and delivered to the feed roller means 6 which will be described hereinafter. Thereafter, the picking rollers run idle.

The frame 5*a* is fixed to the bottom of the lower case 2 positioned in front of the feed cassette 4. The platen 7 is secured to the frame 5*a* in the right and left directions so that a contact surface with the paper 12 is directed upwardly. In the front and in the rear of the platen 7, the feed roller means 6 and the discharge roller means 8 are mounted on the frame 5*a* in parallel with the platen 7.

The feed roller means 6 and the discharge roller means 8 are constructed of lower driving rollers 6*a*, 8*a* and upper pinch rollers 6*b*, 8*b* confronting these driving rollers. An impingement position between these driving rollers and the pinch rollers is substantially at the same level as the level of the upper surface of the platen 7. The driving rollers 6*a*, 8*a* are also driven by the line feed motor 16 through a gear train (not shown). Each of the driving roller 8*a* and the pinch roller 8*b* of the discharge roller means 8 virtually assumes a cylindrical configuration having a cross section uniformly continuous in the axial direction. An axial plane which passes between the driving roller 8*a* and the pinch roller 8*b* is parallel to an opening surface of a discharge port 20 (see FIG. 6) which will be described later. The total sum of the diameters of the driving roller 8*a* and the pinch roller 8*b* is larger than the width of the discharge port 20. The length of the driving roller 8*a* and the length of the pinch roller 8*b* are greater than the length of discharge port 20. Thus, when viewing the discharge port 20 from the front surface, the discharge port appears to be blockaded by the driving roller 8*a* and the pinch roller 8*b*.

The printing head 10 is of the impact type for effecting printing by thrusting out printing wires (not illustrated). The printing head 10 shifts along a first guide shaft 21 and a second guide shaft 22 with the printing unit being directed downwardly. Fitted slidably to the first guide shaft 21 is a slider 23 having a hole with almost the same diameter as that of the shaft 21 and includes a cylindrical member (not shown), formed of a synthetic resin or the like and bonded to the inner surface thereof for reducing the friction. A groove is formed in the lower part of the slider 23. A protrusion 10*a* formed on the rear side surface of the printing head 10 is fixedly fitted in this groove with a screw or the like (not shown). More specifically, one end of the printing head 10 is slidably supported on the first guide shaft 21 through the slider 23. On the other hand, a receiving part 10*b* is formed integrally with a side surface opposite to the portion to which the slider 23 is fixed. The receiving part 10*b* has a U-shaped groove 10*c* opened on the front side. The second guide shaft 22 is fitted in this groove 10*c*. The second guide shaft 22 is fixed to the cover 3 (see FIG. 6) in parallel with the first guide shaft 21 through the bracket 3*a* (the bracket is omitted in FIG. 2), the cover 3*a* being rotatably supported on the frame 5*a* through a pin 3*b*.

Figure 6:
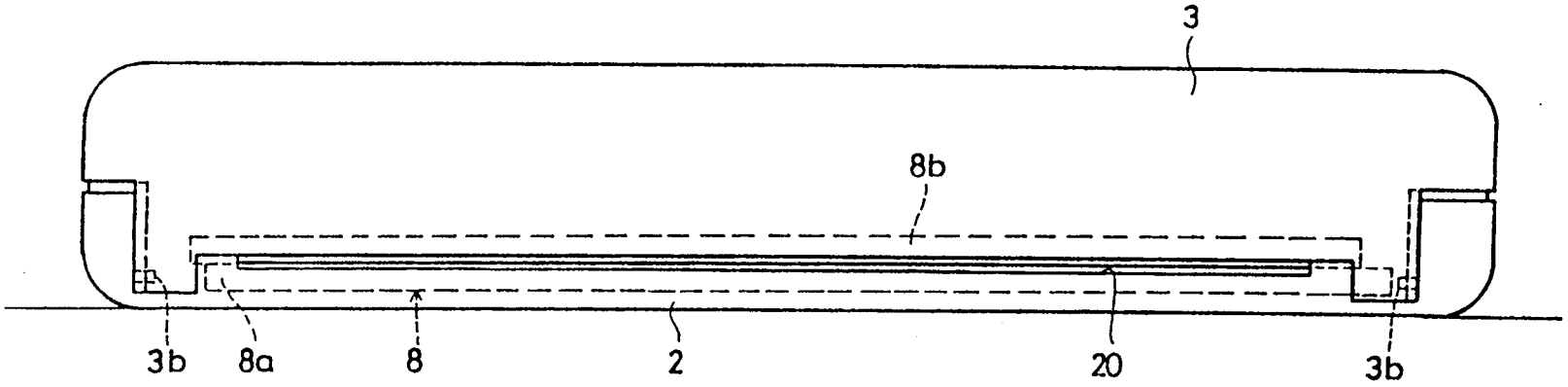
FIG. 6 is a front elevational view showing the printer of FIG. 1.

The cover 3 has an L-shape configuration and, as illustrated in FIGS. 1 and 6, constitutes a front part of the upper surface of the printer case. When the cover 3 is closed, the top end of the cover impinges on the front end of the upper case 1. When the cover 3 is opened, the front part of the interior of the printer case is exposed. In the closed state of the cover 3 as shown in FIG. 6, the edge of the front surface of the lower case 2 confronts the edge of the front surface of the cover 3. In this confronting position, however, an elongate recess is formed in the lower case 2. This recess and the edge of the front surface of the cover 3 are combined to form a slit. The slit in turn serves as the discharge port 20 which was previously described.

Next, the driving operation of the printing head 10 will be explained.

As illustrated in FIG. 2, a carriage motor 26 is mounted on the left part of the frame 5*b*. Pulleys 27, 28, 29, 30, 31 and 32 are disposed on the frame 5*b*. That is, the carriage motor 26 and the pulleys 27 through 32 do not overlap in a shift region of the print head unit, i.e., in the shift region of the printing head 10, the slider 23 and the receiving part 10*b*. The carriage motor and the pulleys are also disposed in positions which are not in the line of extension of the shift region of the printer head unit, that is, they are disposed sideways from the shifting direction of the printer head. As fully illustrated in FIG. 5, the pulley 30 is integrally formed with a gear 30*a* meshing with a pinion 26*a* of the carriage motor 26. A U-shaped protrusion 23*a* is formed at the upper end of the slider 23. A part of an endless timing belt 33 is fitted in the U-shaped protrusion 23*a*. The timing belt 33 is wound zigzag on the pulleys 27 to 32. To be specific, the timing belt 33 is wound on the pulleys 30, 31 from outside and on the pulleys 28, 31 from inside. The timing belt 33 is also wound on the pulleys 27, 32 disposed at both ends of the frame 5*a* from outside, these pulleys stretching straight the belt 33 in the right and left directions from the position of the protrusion 23*a*. The timing belt 33 is driven by the carriage motor 26, and the printing head 10 is thereby driven. The carriage motor 26 makes forward and reverse rotations, and hence the printing head 10 makes a reciprocating motion.

Figure 3:
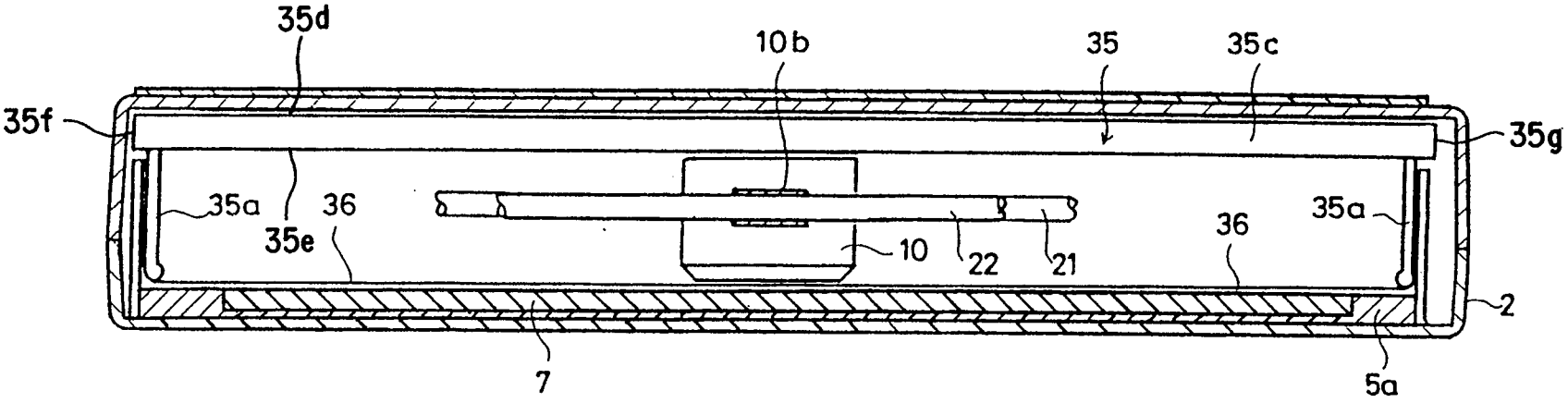
FIG. 3 is a sectional view taken substantially along the line 3—3 of FIG. 1.

A ribbon cassette 35 is placed above the printing head 10. The ribbon cassette 35 has, as illustrated in FIG. 3, arms 35*a* on both sides. An ink ribbon 36 stretched on the arms 35*a* is set between the platen 7 and the printing head 10. A body 35*c* has a hollowed interior in which the ink ribbon 36 folded zigzag is accommodated. The ribbon cassette 35 can be easily loaded from the direction of arrow Y of FIG. 1 in the opened state of the cover 3. More specifically, the second guide shaft 22 is fixed to the cover 3 and comes off the receiving part 10*b* in the opened state of the cover 3. The printing head 10 is then supported only on the first guide shaft 21 and rotatable about the guide shaft 21. Hence, the ink ribbon 36 is easily set between the printing head 10 and the platen 7 by expanding the gap therebetween.

Figure 5:
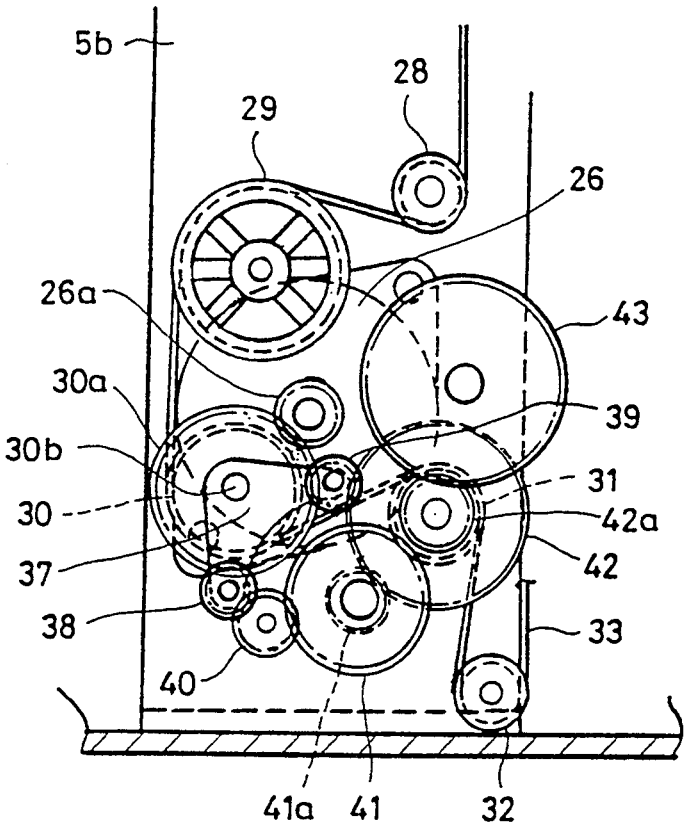
FIG. 5 is an enlarged view showing the portions in the vicinity of a carriage motor and a ribbon driving gear train.

The driving operation of the ribbon cassette 35 will next be described. Referring to FIG. 5, an L-shaped lever 37 has an opening which is closely fitted to a shaft 30*b* supporting the pulley 30. Idlers 38, 39 are fitted to two ends of this lever 37 and mesh with the gear 30*a*. The lever 37 pivots about the shaft 30*b* by the force of friction between the shaft 30*b* and the closely fitted opening in the L-shaped lever 37 when the gear 30*a* rotates. Therefore, when the pulley 30 rotates counterclockwise, the lever 37 undergoes a counterclockwise rotating force due to the friction. Then, the idler 38 meshes with a gear 40. When the idler 38 meshes with the gear 40, the gear 30*a* continues to rotate and the pulley 30 thereby continues to rotate counterclockwise. The gear 40 meshes with a gear 41. A pinion 41*a* of the gear 41 meshes with a gear 42 (separately rotating, although the pulley 31 and the gear 42 are coaxial with each other but rotate separately) coaxial with the pulley 31. A pinion 42*a* of the gear 42 meshes with a ribbon driving gear 43 which is thereby rotated clockwise. Namely, when the pulley 30 rotates counterclockwise, the ribbon driving gear 43 rotates clockwise. Reversely, when the pulley 30 rotates clockwise, the lever 37 undergoes a clockwise pivoting force due to the friction. Then, the idler 38 is out of mesh with the gear 40 and the idler 39 meshes with the gear 41. When the idler 39 meshes with the gear 41, the gear 30*a* continues to rotate and the pulley 30 thereby. Hence, when the pulley 30 rotates clockwise the ribbon driving gear 43 also rotates clockwise. The ribbon cassette 35 incorporates a pair of non-illustrated ribbon feed rollers meshing with the ribbon driving gear 43. The ink ribbon 36 is moved along the arm 35*a* by the ribbon feed rollers. Note that the ink ribbon 36 is vertically accommodated in the body 35*c* of the ribbon cassette 35 and turned at a right angle when being inserted between the arms 35 from within the body 35*c*. The ribbon cassette body 35*c* has spaced, generally planar side walls 35*d* and 35*e* (FIG. 3) which are generally parallel to said straight line path, end walls 35*f*, 35*g*, and lateral walls 35*h*, 35*i* (FIG. 1). The height or thickness (the distance between the side walls 36*d*, 36*e*) of the ribbon cassette body 35*c* is less than its width (the distance between end walls 35*f*, 35*g*) and less than its length (the distance between lateral walls 35*h*, 35*i*).

In the thus constructed printer, during the printing process the paper 12 in the feed cassette 4 is taken out by the picking rollers 15. The fetched paper 12 is fed substantially horizontally between the head 10 and the platen 7 by means of the feed roller means 6. The printing wires set in the printing head impinge on the paper 12 via the ink ribbon 36 in response to a printing signal, thus effecting the printing process. The paper 12, after being printed, is fed substantially horizontally to the discharge roller means 8 by the carrying force of the feed roller means 6. The paper 12 passes by the discharge roller means 8 and is taken out substantially horizontally from the discharge port 20. Thus, the paper being printed passes along a substantially straight lien path along the length of the printer case.

In the printer employed in this manner, the printing head 10 is disposed upwardly of the platen 7 so as to confront the platen 7. The feed cassette 4, the feed roller means 6 and the discharge roller means 8 are disposed sideways in line. With this arrangement, these components are placed compactly in the vertical direction. Therefore, the printer can be made thin.

The printer case has a plane box-like configuration in which the upper surface is flat. With this arrangement, a personal computer, a word processor and the like can be placed on the printer case. This printer case is convenient in terms of installation space, operability and so on.

The feed cassette 4 is loaded in such a way that the cassette is superimposed with the circuit board 48 in the bottom of the printer case. The feed cassette is housed without a voluminous printer case. The feed cassette 4 is disposed in a dead space juxtaposed to the circuit board 48. This does not lead to an increase in size of the printer case. Instead, the printer case can be miniaturized.

The feed cassette is loaded on the bottom of the printer case but may be loaded sideways from the upstream side of the printing head and the platen as well. For instance, the feed cassette may be loaded in a space 11 formed upwardly of the printer case, and the circuit board 48 may be placed in a position lower than the cassette. Regarding the loading direction of the feed cassette, for example, the feed cassette may be loaded in a right-angled direction on the plane of FIG. 1 or from the underside in the FIG. 1 arrangement.

Next, another embodiment of the present invention will be described with reference to FIGS. 7 and 8.

Formed between the upstream side of the lower case 102 and a bottom 101*a* of an upper case 101 is a paper housing portion 150 superimposed with the circuit board 48 and disposed sideways on the upstream side of the platen 7. An upstream end of the paper housing portion 150 is opened. A frame 5*b* is fixed on the downstream side of the upper case 101. A frame 5*a* is fixed to the bottom on the downstream side of the lower case 102. A protrusion 102*a* is provided for regulating movement of the front end of the paper.

An openable/closable cover 151 for opening and closing an opening 150*a* of the paper housing portion 150 is provided at the upstream end of the lower case 102.

The stacked papers 112 are charged into the paper housing portion 150 from the opening 150*a*. A hopper plate (see FIG. 8) is attached to the downstream bottom of the lower case 102. The hopper plate 13 has, as shown in FIG. 8, a T-shaped configuration. A root part 13*c* thereof is axially supported in such a manner that the root part 13*c* is fitted in a hole 102*b* in the lower case 102. The hopper plate is swayable about this point.

Figure 7:
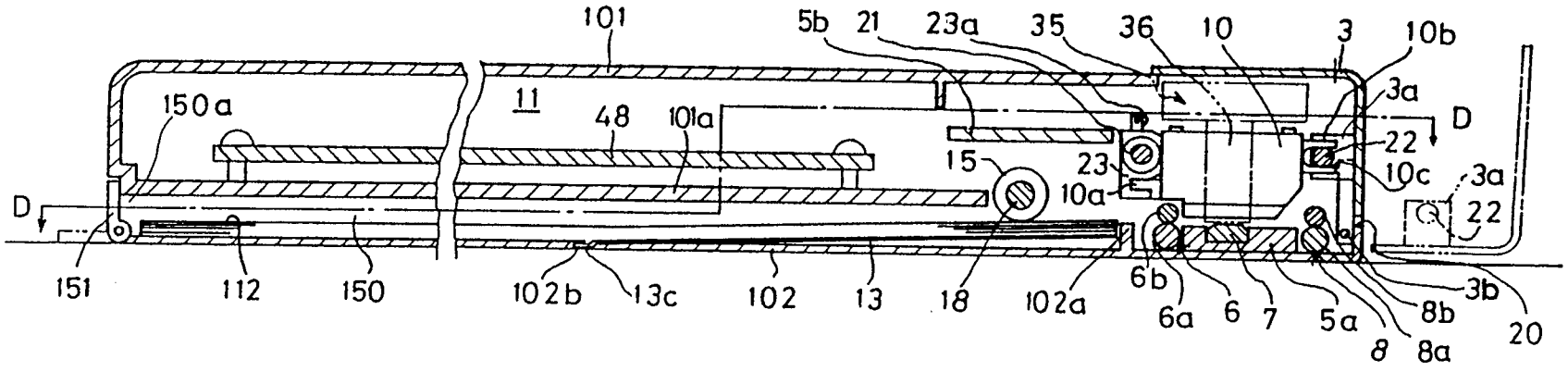
FIG. 7 is a sectional view corresponding to FIG. 1, showing another embodiment of the present invention.
Figure 8:
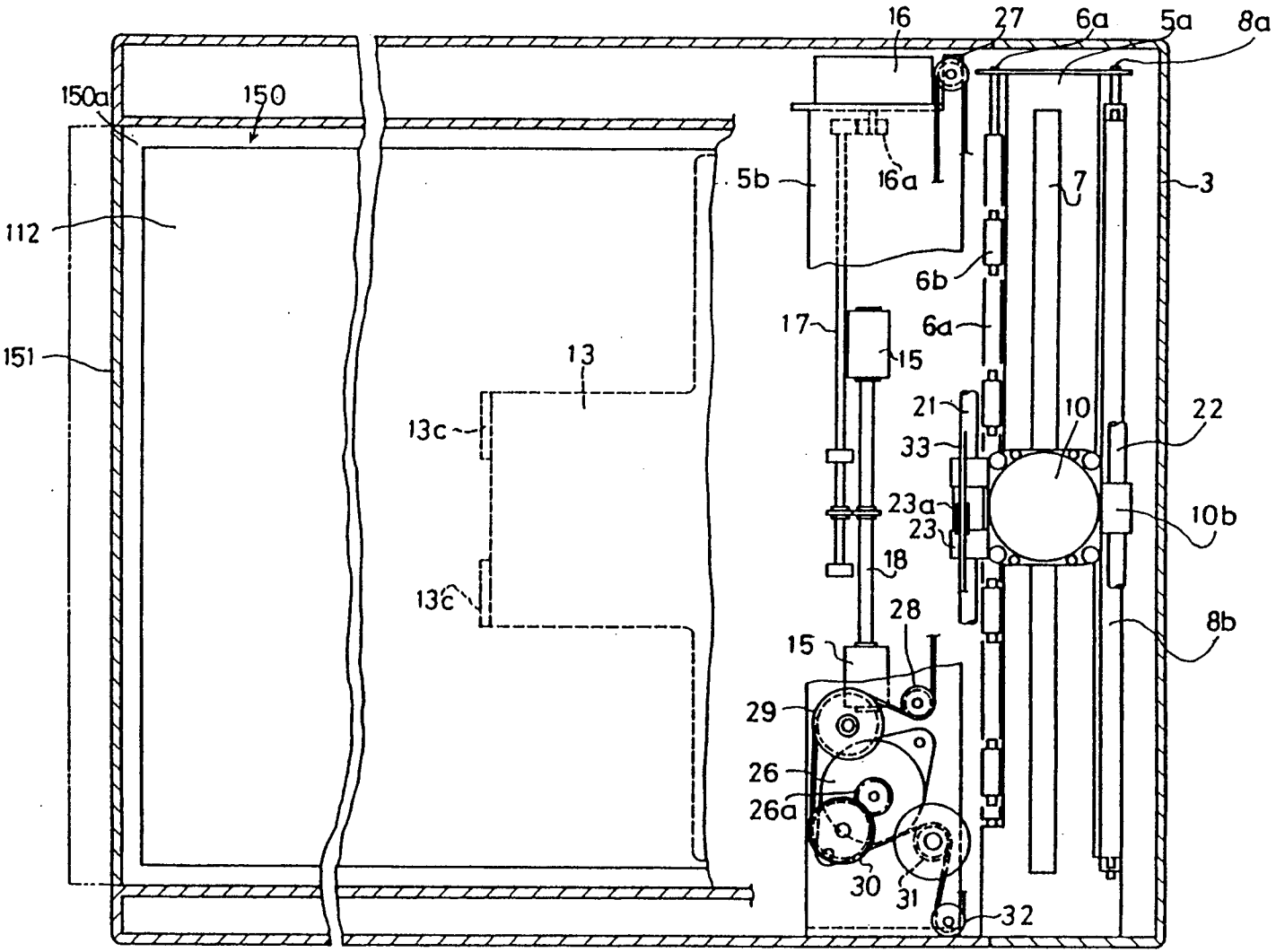
FIG. 8 is a sectional view taken substantially along the line D—D of FIG. 7.

In the thus constructed printer, as shown in FIG. 7, the cover 151 is at first opened to feed the paper 112 into the paper housing portion 150 from the left side of the printer. The top end of the paper 112 contacts the protrusion 102*a*, with the result that the paper 112 can not make a further forward movement. The paper 112 is thus positioned within the printer and housed in the paper housing portion 150.

Thereafter, dust and the like is prevented from entering the paper housing portion 150 from the outside of the printer by closing the cover 151.

Hence, in this embodiment the printer case encases the paper housing portion 150 but does not require a holding mechanism for holding the feed cassette. Thus, no extra cost and no extra space are required.

Note that in this embodiment the paper housing portion 150 is provided on the bottom of the printer case but may be provided on the upstream side of the platen 7 within the printer case. The arrangement is not limited to this embodiment. Thus, alternatively, the cover for closing the opening 150*a* may be omitted.

Figure 9:
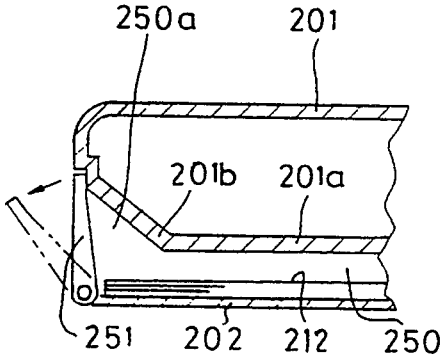
FIG. 9 is a sectional view of the principal portion showing still another embodiment of the present invention.

Still another embodiment of the present invention will hereinafter be described with reference to FIG. 9.

An upstream end 201*b* of a bottom 201*a* of an upper case 201 is inclined upwards. An upstream end of a paper housing portion 250 provided between the bottom 201*a* and a lower case 202 is thereby formed with an opening 250*a* opened wider than the height of the paper housing portion 250.

An openable/closable cover 251 for covering an opening 250*a* is provided at an upstream end of the lower case 202.

The cover 251 is, as indicated by a broken line, stopped obliquely at an open angle of 90 degrees or under by means of an unillustrated click or stopper when opening the cover 251.

Based on the above-described construction, when loading the papers 212 into the printer, the cover 251 is opened obliquely. The papers 212 are thereby guided obliquely by the upstream end 201*b* of the bottom 201*a* of the upper case 201 and the cover 251 as well. Thus, the paper 212 can be inserted obliquely into the printer. It is therefore possible to reduce the space required for feeding the paper, which is formed on the left side of the printer. The printer can be installed so that, e.g., the left part of the printer is positioned very closely to the wall. The space for the printer including feeding of the paper can be diminished.

The respective embodiments discussed above have dealt with the arrangement in which the printing head is so disposed above the platen as to be directed downwardly. The printing head may, however, be so disposed under the platen as to be directed upwardly.

The respective embodiments described above involve the use of an impact type head for effecting printing by thrusting out the printing wires. However, as a matter of course, other printing systems may be adoptable, wherein, for example, a thermal transfer head may be used.

As discussed above, in the dot printer of this invention, the components such as the paper housing portion, the platen, the printing head, the feed roller and the discharge roller are disposed compactly in the vertical direction. The printer can therefore be made thin. The paper housing portion is incorporated into the printer case. The papers are housed in the paper housing portion in the printer case. Hence, it is unnecessary to provide a holding mechanism for holding the feed cassette. No extra cost and no extra space are required. The dot printer can be miniaturized, resulting in a decrease in costs. When encasing the paper housing portion in the printer case, the upstream end of the paper housing portion is opened, and a cover capable of opening and closing this opening is provided at this opening. Dust and the like can be prevented from entering the paper housing portion from the outside of the printer case. The paper housing portion is so incorporated into the printer case as to overlap the drive control circuit board. With this arrangement, the paper housing portion is placed in the dead space peripheral to the circuit board, thereby attaining miniaturization thereof. The printer case is shaped in a plane box-like configuration in which the upper surface is flat. A personal computer and the like can therefore be placed on the printer case. This is convenient in terms of installation space, operability and the like.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

We claim:

1. A printer comprising:

a casing;

a printer head and a platen disposed in superimposed relationship in said casing;

a paper housing means in said casing disposed on the upstream side of said printer head;

paper feed means in said casing disposed between said paper housing means and said printer means;

paper discharge means in said casing disposed on the downstream side of said printer head;

said paper housing means, said paper feed means, said printer head and platen, and said paper discharge means being disposed in aligned array to provide a substantially straight line path for the paper being printed as said paper passes from said paper housing means of said paper feed means, between said printer head and platen, and to said paper discharge means;

said paper housing means storing a stack of paper sheets which are disposed completely within said casing and which are substantially parallel to said substantially straight line path;

a drive control circuit board means, said drive control circuit board means being disposed in superimposed relationship within said paper housing means; and a ribbon cassette comprising a ribbon body and arms extending from said ribbon body, said ribbon body being disposed in superimposed relationship with said printer head and said platen, said ribbon body having spaced generally planar side walls generally parallel to said substantially straight line path, said spaced generally planar side walls each having a length and a width each greater than the spacing between said spaced generally planar side walls.

2. A dot printer according to claim 1, wherein said paper housing means comprises a paper cassette which is insertable into and withdrawable from said casing.

3. A dot printer according to claim 1, wherein said paper housing means is formed as part of said casing.

4. A dot printer according to claim 1, wherein said casing has an upstream end, said casing having a cover at said upstream end which is moveable between open and closed positions such that access is provided to said paper housing means when said cover is in said open position.

5. A dot printer according to claim 1 further comprising a drive control circuit board means disposed in said casing in superimposed relationship with said paper housing means.

6. A dot printer according to claim 1, wherein said casing means has a box-like configuration housing an upper surface which is substantially flat.

7. A printer according to claim 1, wherein said casing has a top wall and a bottom wall spaced from said top wall and parallel to said top wall with the distance between said top and bottom walls defining the height of said casing, said printer head being operable in a printing direction substantially perpendicular to said parallel top and bottom walls.

8. A printer according to claim 1, wherein said casing has a downstream end wall which has said opening through which said paper which has been printed is discharged from said casing, said casing having an upstream end wall having another opening providing access to said paper housing means.

9. A printer according to claim 1, wherein said printer head means is operable in a printing direction substantially perpendicular to said straight line path.

10. A printer according to claim 1 further comprising guide rod means for reciprocably guiding said printer head, mounting means removably mounting said ribbon cassette in said casing, said ribbon cassette having a ribbon, and motor drive means for reciprocably driving said printer head means on said guide rod means and for driving said ribbon.

11. A printer according to claim 1, wherein said motor drive means comprises a reversible motor which reverses its direction for each reciprocal movement of said printer head means, said motor drive means being operable to drive said ribbon in a single direction as said reversible motor reverses its direction.

12. A printer according to claim 1, wherein said casing has flat top which is substantially parallel to said substantially straight line path.

13. A printer according to claim 1, wherein said casing comprises a casing bottom which is substantially parallel to said substantially straight line path, said paper housing means being disposed at said casing bottom.

14. A printer according to claim 1, wherein said paper housing means comprises a paper cassette which is insertable and withdrawable from said casing in a direction parallel to said substantially straight line path.

15. A printer according to claim 1, wherein said casing has an elongated top wall and an elongated bottom wall, said top and bottom walls being substantially parallel to said substantially straight line path.

16. A printer according to claim 15, wherein said casing has an upstream end wall extending between said top and bottom walls, said upstream end wall being perpendicular to said top and bottom walls, said casing having a downstream end wall extending between said top and bottom walls, said downstream end wall being perpendicular to said top and bottom walls.

17. A printer according to claim 15, wherein said casing has an upstream end wall means extending between said top and bottom walls, said upstream end wall means having access means providing access to said paper housing means.

18. A printer according to claim 17, wherein said opening means comprises an access in said upstream end wall and a cover pivotably mounted on said casing between a closed position closing said opening and an open position in which said opening is uncovered.

19. A printer according to claim 18, wherein said paper housing means comprises a paper cassette slidably mounted in said casing between an inserted position and a withdrawn position, said paper cassette passing through said opening when said paper cassette is moved from said inserted to said withdrawn position.

20. A printer according to claim 19, wherein said paper cassette has a bottom wall coplanar with said casing bottom wall when said paper cassette is in said inserted position.

21. A printer according to claim 19, wherein said paper cassette moves generally along a linear path in moving between said inserted and said withdrawn positions, said linear path being substantially parallel to said substantially straight line path.

22. A printer according to claim 1 further comprising means for mounting said drive control circuit board means on said paper housing means.

23. A printer according to claim 1, wherein said casing has a downstream end wall having an opening through which is discharged the paper which has been printed.

24. A printer according to claim 1, wherein said ribbon cassette body overlies said printer head and said platen underlies said printer head.

25. A printer according to claim 1, wherein said platen is stationary.

26. A printer according to claim 1, wherein said casing mounts a frame which underlies said printing head, said platen being fixedly mounted in said frame.

27. A printer according to claim 1, wherein said paper housing means stores flat sheets of paper to be printed, said paper housing means storing said flat sheets of paper in a disposition such that the plane of said flat sheets of stored paper is substantially parallel to said straight line path.

28. A printer according to claim 27, wherein said paper housing means further comprises a roller means and a biased hopper plate biasing said stack of flat sheets of paper toward said picking roller means.

29. A printer according to claim 1, wherein said printer head is an impact printer head.

30. A printer comprising:

a casing;

a printer head and a platen disposed in superimposed relationship in said casing;

guide rod means for reciprocably guiding said printer head;

a paper housing means in said casing disposed on the upstream side of said printer head, said paper housing means housing a stack of paper sheets;

picking roller means disposed to confront said paper housing means and operable to deliver separate paper sheets from said stack of paper sheets;

feed roller means in said casing disposed between said paper housing means and said paper head receiving said delivered paper sheet and feeding said paper sheet between said platen and said printer head;

discharge roller means in said casing disposed on the downstream side of said printer head;

an opening means in said casing for discharging the paper sheet printed by said printing head;

said paper housing means, said feed roller means, said printer head and platen, said discharge roller means, and said opening being disposed in aligned array to provide a substantially straight line path for the paper being printed as said paper passes from said paper housing means to said feed roller means, between said printer head and platen, to said discharge roller means and out of said casing through said opening of said casing;

a ribbon cassette having a ribbon;

mounting means removably mounting said ribbon cassette in said casing, motor drive means for reciprocably driving said printer head on said guide rod means and for driving said ribbon, said motor drive means comprising a reversible motor which reverses its direction for each reciprocal movement of said printer head, said motor drive means being operable to drive said ribbon in a single direction as said reversible motor reverses its direction, said motor drive means comprising a drive gear driven alternately clockwise and counterclockwise by said reversible motor, a shaft mounting said drive gear, a rockable lever on said shaft which is rockable to a first position when said drive gear rotates in one direction and which rocks to a second position when said drive gear rotates in an opposite direction, said rockable lever having a first and a second lever gear each continuously meshing with said drive gear, said motor drive means further comprising a first transfer gear meshing with a second transfer gear, said first lever gear meshing with said first transfer gear when said rockable lever is in said first position, said second lever gear meshing with said second transfer gear when said rockable lever is in said second position.

31. A printer according to claim 30, wherein said second lever gear is out of mesh with said second transfer gear when said rockable lever is in said first position and said first transfer gear is out of mesh with said first transfer gear when said rockable lever is in said second position.

32. A printer according to claim 31, wherein said second transfer gear is driven in one direction by said first transfer gear when said rockable lever is in said first position and said second transfer gear is driven in said one direction by said second lever gear when said rockable lever is in said second position, whereby said second transfer gear is driven in the same direction as said reversible motor alternately reverses its direction in reciprocably driving said printer head means.

33. A printer according to claim 30, wherein said motor drive means comprises an endless drive belt and pulleys about which said endless belt passes, said endless drive belt being connected to said printer head means, one of said pulleys being mounted on said shaft being rotated by said drive gear to thereby reciprocably drive said endless belt.

34. A printer comprising:

a casing having an elongated top wall and an elongated bottom wall;

a printer head and a platen disposed in superimposed relationship in said casing;

a paper housing means in said casing disposed on the upstream side of said printer head;

paper feed means in said casing disposed between said paper housing means and said printer means;

paper discharge means in said casing disposed on the downstream side of said printer head;

said paper housing means, said paper feed means, said printer head and platen, and said paper discharge means being disposed in aligned array to provide a substantially straight line path for the paper being printed as said paper passes from said paper housing means to said paper feed means, between said printer head and platen, and to said paper discharge means;

a ribbon cassette comprising a ribbon body and arms extending from said ribbon body, said ribbon body being disposed in superimposed relationship with said printer head, said ribbon body having a height which is measured perpendicular to said substantially straight line path, a length which is measured parallel to said substantially straight line path and a width which is measured perpendicular to said length and perpendicular to said height, said height being less than said length and less than said width;

said top and bottom walls of said casing being substantially parallel to said substantially straight line path, said casing having an upstream lateral wall extending between said top and bottom walls, said paper housing means being disposed within said casing between said upstream lateral wall and said printer head.

35. A printer according to claim 34, wherein said printer head is an impact printer head which effects printing by thrusting out printing wires.

36. A printer according to claim 34, wherein said printer head and platen are disposed in said superimposed relationship so as to define a printing direction which is substantially perpendicular to the plane of the paper being printed as said paper passes between said printer head and platen.

37. A printer according to claim 36, wherein said substantially straight lien path extends in a horizontal direction and said printing direction extends in a vertical direction during normal use of the printer.

38. A printer according to claim 34, wherein said platen is a fixed platen extending linearly in a longitudinal direction, said platen having a longitudinal length measured in said longitudinal direction, said width of said ribbon cassette body being at least as long as said longitudinal length of said platen.

39. A printer according to claim 34, wherein said paper housing means is disposed completely in said casing between said top and bottom walls and between said upstream lateral wall and said printer head.

40. A printer according to claim 39, wherein said casing has access means providing access to said paper housing means in said casing.

41. A printer according to claim 40, wherein said access means is in said upstream lateral wall.

42. A printer according to claim 34, wherein said platen extends linearly in a longitudinal direction, said longitudinal direction being perpendicular to said substantially straight line path, said width of said ribbon cassette being measured parallel to said longitudinal direction.

43. A dot printer comprising:

a printer casing;

a platen and an impact type printer head disposed to confront one another in said printer casing with said printer head and said platen being disposed in superimposed relationship;

a ribbon cassette means in said casing, said ribbon cassette means comprising a ribbon body and arms extending from said ribbon body, said ribbon body being disposed in superimposed relationship with said printer head and said platen;

a paper housing means for accommodating a stack of paper sheets disposed on the upstream side of said printer head in said printer casing, said stack of paper sheets being completely disposed within said printer casing;

a drive control circuit board means disposed in said casing in superimposed relationship with said paper housing means;

picking roller means disposed to confront said paper housing means and operable to deliver separate paper sheets from said stack of paper sheets;

feed roller means disposed on the upstream side of said printer head between said paper housing means and said printer head for receiving said delivered paper sheet and feeding said paper sheet between said platen and said printer head;

discharge roller means disposed on the downstream side of said printer head for discharging a printer paper sheet printed by said printer head;

an opening in said printer casing for discharging said printer paper sheet;

said paper housing means, said picking roller means, said feed roller means, said printer head, said platen, said discharge roller and means said opening being disposed to define a straight line paper path from said paper housing means to said opening;

said ribbon body having spaced generally planar side walls which are generally parallel to said substantially straight line path and which have a length and a width each greater than the spacing between said spaced generally planar side walls.

44. A dot printer according to claim 43, wherein said picking roller means comprises a picking roller and a motor driving said picking roller.

45. A printer comprising:

a casing;

an impact printer head and a platen disposed in superimposed relationship in said casing;

a paper housing means in said casing disposed on the upstream side of said printer head;

paper feed means in said casing disposed between said paper housing means and said printer means;

paper discharge means in said casing disposed on the downstream side of said printer head;

said paper housing means, said paper feed means, said printer head and platen, and said paper discharge means being disposed in aligned array to provide a substantially straight line path for the paper being printed as said paper passes from said paper housing means to said paper feed means, between said printer head and platen, and to said paper discharge means;

a ribbon cassette comprising a ribbon body and arms extending from said ribbon body, said ribbon body being disposed in superimposed relationship with said printer head, said ribbon body having a height which is measured perpendicular to said substantially straight line path, a length which is measured parallel to said substantially straight line path and a width which is measured perpendicular to said length and perpendicular to said height, said height being less than said length and less than said width;

said casing having a top wall and a bottom wall, said top and bottom walls being spaced from one another, said casing having an upstream end wall extending between said top and bottom walls, said paper housing means being disposed within said casing between said top and bottom walls and being said upstream end wall and said printer head.

46. A printer comprising:

a casing;

a printer head and a platen disposed in superimposed relationship in said casing, guide rod means for reciprocally guiding said printer head;

a drive control circuit board means disposed in said casing in superimposed relationship with said paper housing means;

paper feed means in said casing disposed between said paper housing means and said printer means;

paper discharge means in said casing disposed on the downstream side of said printer head;

said paper housing means, said paper feed means, said printer head and platen, and said paper discharge means being disposed in aligned array to provide a substantially straight line path for the paper being printed as said paper passes from said paper housing means to said paper feed means, between said printer head and platen, and to said paper discharge means;

a ribbon cassette comprising a ribbon body and arms extending from said ribbon body, said ribbon body being disposed in superimposed relationship with said printer head, said ribbon body having a height which is measured perpendicular to said substantially straight line path, a length which is measured parallel to said substantially straight line path and a width which is measured perpendicular to said length and perpendicular to said height, said height being less than said length and less than said width;

said casing having a top wall and a bottom wall, said top and bottom walls being spaced from one another, said casing having an upstream end wall extending between said top and bottom walls, said paper housing means being disposed within said casing between said top and bottom walls and between said upstream end wall and said printer head; and mounting means removably mounting said ribbon cassette in said casing, said ribbon cassette having a ribbon, and motor drive means for reciprocally driving said printer head on said guide rod means and for driving said ribbon, said motor drive means being disposed laterally of and in non-superimposed relationship with said ribbon cassette.

47. A dot printer comprising:

a printer casing;

a platen and an impact type printer head disposed to confront one another in said printer casing with said platen and said printer head being vertically disposed one over the other;

a ribbon cassette comprising a ribbon body for accommodating an ink ribbon and further comprising arms extending from said body for positioning said ink ribbon between said platen and said printer head;

a ribbon drive means for driving said ink ribbon;

a paper housing means for accommodating a stack of paper sheets disposed on the upstream side of said printer head, said stack of paper sheets being disposed completely in said printer casing;

a drive control circuit board means disposed in said casing in superimposed relationship with said paper housing means;

picking roller means disposed to confront said paper housing means and operable to deliver separate paper sheets from said stack of paper sheets;

feed roller means disposed on the upstream side of said printer head between said paper housing means and said printer head for receiving said delivered paper sheet and feed said paper sheet between said platen and said printer head;

discharge roller means disposed on the downstream side of said printer head for discharging a printer paper sheet printed by said printer head;

an opening in said printer casing for discharging said printer paper sheet;

said paper housing means, said picking roller means, said feed roller means, said printer head, said platen, said discharge roller means and said opening being disposed to define a substantially straight line paper path from said paper housing means to said opening;

said ribbon body being disposed in superimposed relationship with said printer head;

said ribbon body having spaced generally planar side walls which are generally parallel to said substantially straight line path and which have a length and a width each greater than the spacing between said spaced generally planar side walls;

said ribbon drive means being disposed laterally of and in non-superimposed relationship with said ribbon cassette.

* * * * *